United States Patent [19]

Hirota

[11] 4,070,546

[45] Jan. 24, 1978

[54] PORTABLE STEREO AUDIO APPARATUS

[75] Inventor: Kashichi Hirota, Hachioji, Japan

[73] Assignee: Kyowa Denki Kagaku Kabushiki Kaisha, Tokyo, Japan

[21] Appl. No.: 705,777

[22] Filed: July 13, 1976

[30] Foreign Application Priority Data

Aug. 29, 1975 Japan ..... 50-119169

[51] Int. Cl.[2] ..... H04R 1/02

[52] U.S. Cl. ..... 179/1 GA; 179/1 E

[58] Field of Search ..... 179/1 G, 1 E, 1 AT, 179/1 GA, 100.4 ST, 15 BT; 84/DIG. 1; 325/352, 355

[56] References Cited

U.S. PATENT DOCUMENTS

| | | | |
|---|---|---|---|
| 3,135,837 | 6/1964 | Tateishi | 179/100.4 ST |
| 3,943,564 | 3/1976 | Tushinsky | 179/1 E |

FOREIGN PATENT DOCUMENTS

| | | | |
|---|---|---|---|
| 1,227,343 | 8/1960 | France | 179/1 E |
| 894,900 | 4/1962 | United Kingdom | 179/1 E |

OTHER PUBLICATIONS

"FM Stereo Radio Service Manual," By General Electric, June 1963, p. front cover.

*Primary Examiner*—Douglas W. Olms
*Attorney, Agent, or Firm*—Cameron, Kerkam, Sutton, Stowell & Stowell

[57] ABSTRACT

A portable stereo audio apparatus consists of a pair of speaker cabinets each containing a loudspeaker and a main cabinet containing electric devices such as amplifiers and a radio receiver. The speaker cabinets and the main cabinet are in the form of rectangular boxes. The speaker cabinets have half the width of the main cabinet and are normally set on the main cabinet. The speaker cabinets are hinged at their lower outer edge to each upper outer edge of the main cabinet so that when the audio apparatus is used as a stereophonic system the speaker cabinets are rotated about the hinges and located at both side of the main cabinet. The speaker cabinets have the edge diagonally opposite the lower outer edge, i.e., the upper inner edge, so formed as to provide gripping means when the speaker cabinets are rotated about the hinges and located on top of the main cabinet that enable the apparatus to be gripped by one hand and toted about.

5 Claims, 3 Drawing Figures

PORTABLE STEREO AUDIO APPARATUS

BACKGROUND OF THE INVENTION

1. Field of the Invention

The present invention relates to a portable stereo audio apparatus which is portable and occupies only a small space when in an unused condition.

2. Description of the Prior Art

Heretofore, there have been well-known various types of stereo audio systems. One type of stereo audio system is a single unit system wherein a receiver, amplifiers and a pair of loud-speakers are contained in a single cabinet. The stereo system of this type is ordinarily of very large size and therefore occupies very much space and floor area in a room. Further, this type of system is difficult for a person to carry. On the other hand, other well-known types of stereo audio systems which have wide use in homes include various separate type or component type systems. In these systems, since a pair of speaker cabinets can be located at desired positions, the desired stereophonic effect is obtained. However, since these systems are constructed of many separate cabinets and components, it is troublesome to carry the system from one room to another or to change its position.

SUMMARY OF THE INVENTION

It is, therefore, an object of the present invention to provide a portable stereo audio apparatus adapted to be brought into a compact size for ease of transporting when it is unused and to be expanded to give excellent stereophonic effect when it is used.

Other objects and effects of the present invention will become apparent from the detailed description of the preferred embodiment of the present invention in conjunction with the accompanying drawings.

DESCRIPTION OF THE PREFERRED EMBODIMENT

Figure 1:
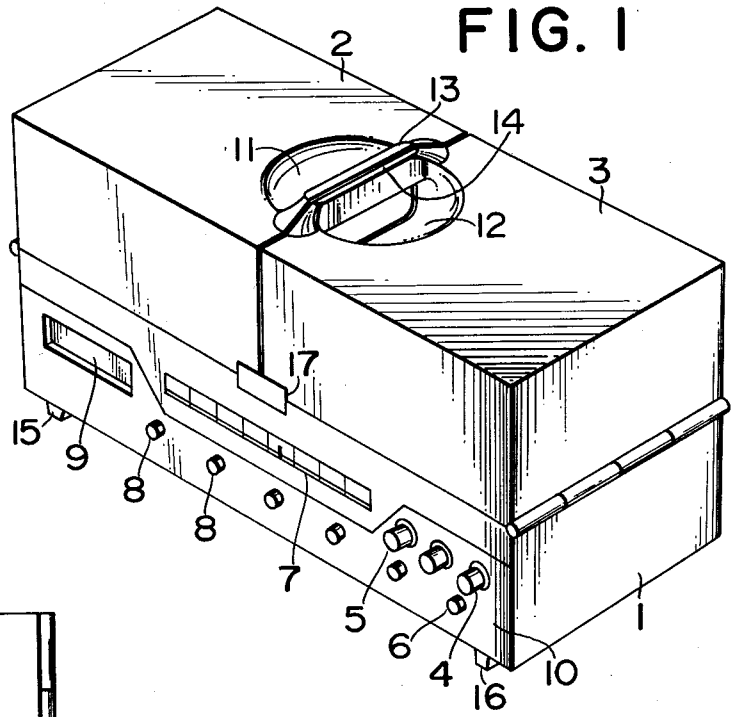
FIG. 1 is a front perspective view of one embodiment of the stereo audio apparatus constructed according to the present invention.
Figure 2:
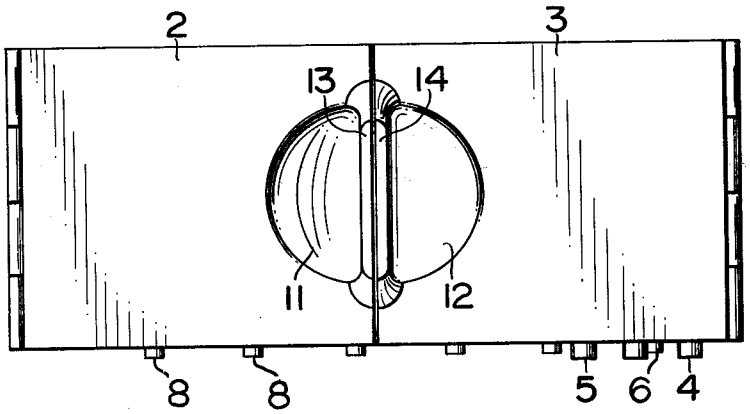
FIG. 2 is a plan view of the stero audio apparatus shown in FIG. 1.
Figure 3:
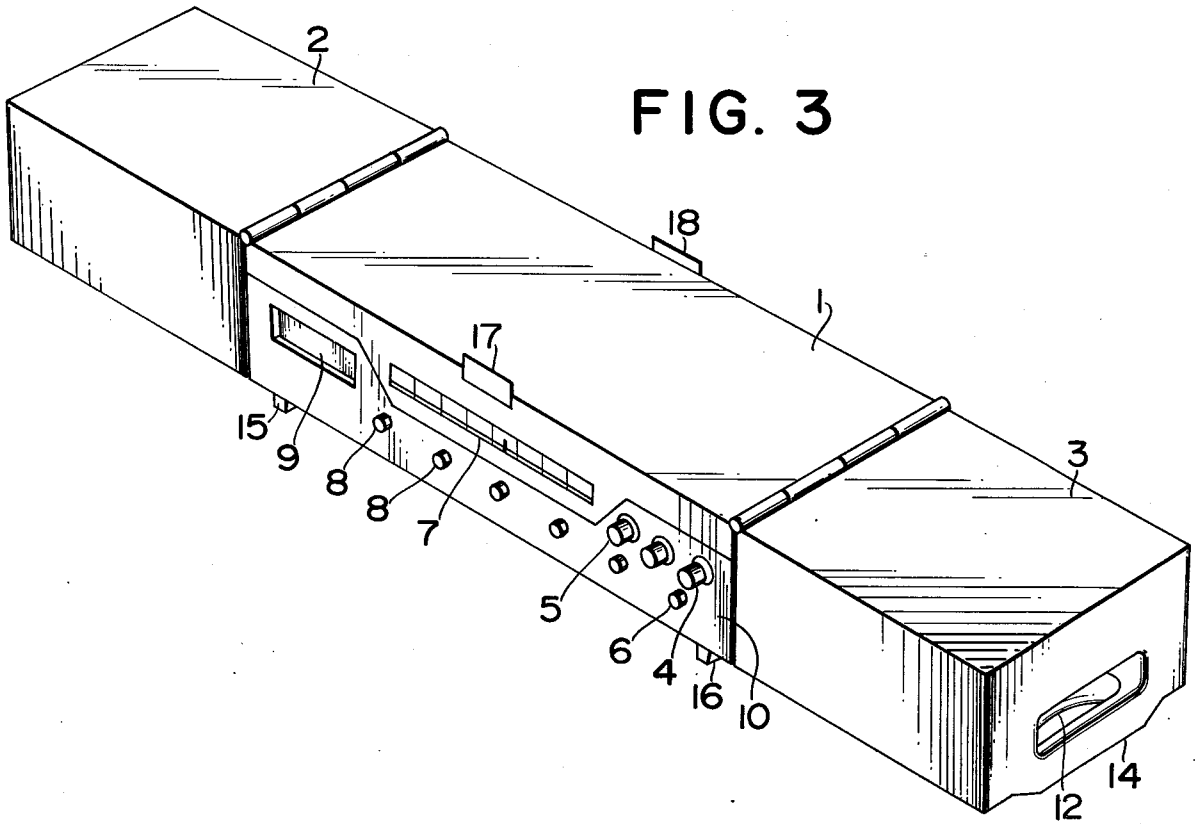
FIG. 3 is a similar view to FIG. 1, but the stereo audio apparatus is in a used condition.

Referring to FIGS. 1 to 3, there is shown a stereo audio apparatus constructed according to the present invention. The stereo audio apparatus comprises a main cabinet 1 and a pair of speaker cabinets 2 and 3. The main cabinet 1 ordinarily contains a radio receiver, a stereo audio reproducer, a pair of preamplifiers, a pair of main amplifiers, etc. (they are not shown), and has, for example, a selector dial 4, tuning dial 5, a power switch 6, an indicator 7, many adjusting knobs 8, and a cartridge tape receiving slot 9, provided on the front panel 10 thereof. The main cabinet is preferably in the form of a rectangular box having a relatively wide width and a relatively low height. Each of the speaker cabinets 2 and 3 contains at least one loudspeaker connected to the corresponding output terminal of the main cabinet 1 through a suitable cable means at the back side thereof. The speaker cabinets may have a composite loudspeaker or a woofer and tweeter if desired. The speaker cabinets are preferably rectangular and of a width one half that of the main cabinet and preferably equal in height and in depth to the main cabinet 1. As shown in FIG. 1, the speaker cabinets 2 and 3 are normally put on the top of the main cabinet 1, and the left side speaker cabinet 2 is hinged at its lower left edge to the upper left edge of the main cabinet 1 while the right side speaker cabinet 3 is hinged at its lower right edge to the upper right edge of the main cabinet 1. Therefore, when the speaker cabinets 2 and 3 are placed on the main cabinet 1, the speaker and main cabinets form one integral and compact rectangular solid body as a whole as shown in FIG. 1.

The speaker cabinets 2 and 3 have quarter-sphere-like recesses 11 and 12 provided respectively on the edges diagonal to the hinged edges thereof. Each of the recesses 11 and 12 is bridged by a gripping rod 13 or 14 extending in the diameter direction parallel to the side edge of the speaker cabinet. When the speaker cabinets are put on the cabinet 1, the gripping rods 13 and 14 match to form a handle grip suitable for a person to grip by one hand for carrying the audio apparatus. Preferably, the gripping rods 13 and 14 are provided with coupling means for coupling the rods with each other.

In the case that the height of the speaker cabinets 2 and 3 is the same as that of the main cabinet 1, the gripping rods 13 and 14 are preferably mounted on the speaker cabinets to be taller than the top surface of the speaker cabinets by the height of legs 15 and 16 of the main cabinet 1, so that when the speaker cabinets are turned down at each side of the main cabinet 1 as shown in FIG. 3, the gripping rods 13 and 14 serve as legs for supporting the speaker cabinets horizontally. Guiding plates 17 and 18 are preferably provided at center upper portions of the front and rear panels of the main cabinet 1 for matching the speaker cabinets on the top of the main cabinet as shown in FIG. 1.

The stereo audio apparatus of the present invention is normally in such a condition that the pair of speaker cabinets 2 and 3 are placed on the main cabinet 1 as shown in FIG. 1. In this condition, as mentioned hereinbefore, the stereo audio apparatus takes the form of a generally cubic and integral box as a whole and occupies only a small account of floor area. It is of good style and appearance. Further, it is easy to carry the apparatus by gripping both of the gripping rods 4 and 5 with a single hand.

If one wishes to use the stereo autio apparatus, the speaker cabinets 2 and 3 are rotated about the hinges and positioned at the opposite sides of the main cabinet 1 as shown in FIG. 3. In this condition, since the speaker cabinets 2 and 3 are apart from each other by a considerable distance, i.e. the width of the main cabinet 1, excellent stereophonic effect is produced by the cooperation of the loudspeakers of the two speaker cabinets. Further, the main cabinet 1 and the speaker cabinets 2 and 3 located at both sides thereof take one relatively flat and elongated rectangular shape of good style and appearance as shown in FIG. 3.

As seen from the above explanation, the stereo audio apparatus of the present invention, when unused, takes a compact shape which occupies only a small area and can be conveniently carried when gripped with a single hand. On the other hand, when one wishes to use the stereo audio apparatus, it can be made into a stereophonic system giving excellent stereophonic effect only by rotating and positioning the speaker cabinets at the opposite sides of the main cabinet.

Although the present invention has been explained hereinbefore with respect to one embodiment of the present invention, it should be understood that any person skilled in the art can change and modify the stereo audio apparatus within the scope and spirit of the present invention defined in the following claims.

I claim:

1. A portable stereo audio apparatus having a main cabinet including a bottom side, a top side and enclosing side walls for housing the stereo electronics, a pair of auxiliary cabinets for housing the speakers for the stereo apparatus, each speaker cabinet adapted to support at least one loud speaker and to be hinged to an edge of the main cabinet so as to be supported, when not in use, on the top side of the main cabinet and when in use on the left side and right side of the main cabinet, respectively, hinge means for hinging the left side speaker cabinet of said speaker cabinet at its lower left edge to an upper left edge of said main cabinet and the right side speaker cabinet at its lower right edge to the upper right edge of said cabinet, whereby the apparatus may be used as a stereophonic system by rotating said speaker cabinets about the hinges to locate them one at either side of said main cabinet to be apart from each other by the width of said main cabinet, each speaker cabinet being one half the width of the main cabinet, the width being defined as the distance between the upper edges of said main cabinet, each of said speaker cabinets including gripping means on the edge diagonal to the hinged edge thereof, so that the respective gripping means of said speaker cabinets are positioned adjacent to each other when the speaker cabinets are positioned on top of said main cabinet and cooperate with each other to form a handle grip member for toting the apparatus.

2. A stereo audio apparatus as set forth in claim 1 wherein each of said gripping means comprises a quarter-sphere like recess at the edge diagonal to the hinged edge of the speaker cabinet and a gripping rod bridging said recess at the diameter thereof, said rods of the respective speaker cabinets being matched to each other to form a single handle grip suitable for gripping with one hand when said speaker cabinets are placed on top of said main cabinet.

3. A stereo audio apparatus as set forth in claim 1 wherein said speaker cabinets are the same in depth as said main cabinet so that when said speaker cabinets are placed on the top of said main cabinet, said speaker cabinets and said main cabinet from one generally cubic-shaped and compact box as a whole 4. A stereo audio apparatus as set forth in claim 1 wherein said speaker cabinets are the same in height as said main cabinet so that when said speaker cabinets are located one on either side of said main cabinet, said speaker cabinets and said main cabinet form one relatively flat and elongated rectangular box.

5. A portable stereo apparatus as set forth in claim 4 wherein said bottom side includes external legs extending therefrom and said gripping rods extend above the top surface of said top side so as to serve as legs for supporting the speaker cabinets horizontally and to maintain said relatively flat elongated rectangular box configuration.

* * * * *